United States Patent [19]

Bowles et al.

[11] 4,007,325

[45] Feb. 8, 1977

[54] FURNACE ASSEMBLY

[75] Inventors: Arnold G. Bowles; Andrew S. D. Crum, both of Warren; Melvin E. Speicher, Tidioute, all of Pa.

[73] Assignee: National Forge Company, Irvine, Pa.

[22] Filed: Aug. 13, 1975

[21] Appl. No.: 604,169

[52] U.S. Cl. ..... 13/22; 174/111; 219/406; 219/420; 219/424

[51] Int. Cl.[2] ..... H05B 3/66

[58] Field of Search ..... 13/20, 22; 219/390, 219/395, 398, 406, 407, 420, 424, 550; 174/111

[56] References Cited

UNITED STATES PATENTS

| | | | |
|---|---|---|---|
| 643,898 | 2/1900 | Hill | 219/424 |
| 3,404,210 | 10/1968 | Weber | 13/22 |
| 3,548,062 | 12/1970 | Smith, Jr. | 13/20 |
| 3,694,628 | 9/1972 | McGuire et al. | 174/111 X |
| 3,749,882 | 7/1973 | Pilkington, Sr. et al. | 13/22 X |

*Primary Examiner*—R. N. Envall, Jr.
*Attorney, Agent, or Firm*—Ronald A. Schapira

[57] ABSTRACT

An electrically heated furnace assembly, suitable for a hot isostatic press, having windings of one or more resistance heating elements, helically wound about the longitudinal axis of the furnace assembly; rigid insulating sleeves, enclosing the heating elements and substantially covering their surfaces; the insulating sleeves abutting against the leading and trailing edges of one another and against the outer, upper and lower surfaces of one another; and a spiral shelf provided about the longitudinal axis of the furnace assembly, underlying the heating elements, and abutting against the outer lower surfaces of the insulating sleeves which enclose the lowermost winding of the resistance heating elements.

25 Claims, 9 Drawing Figures

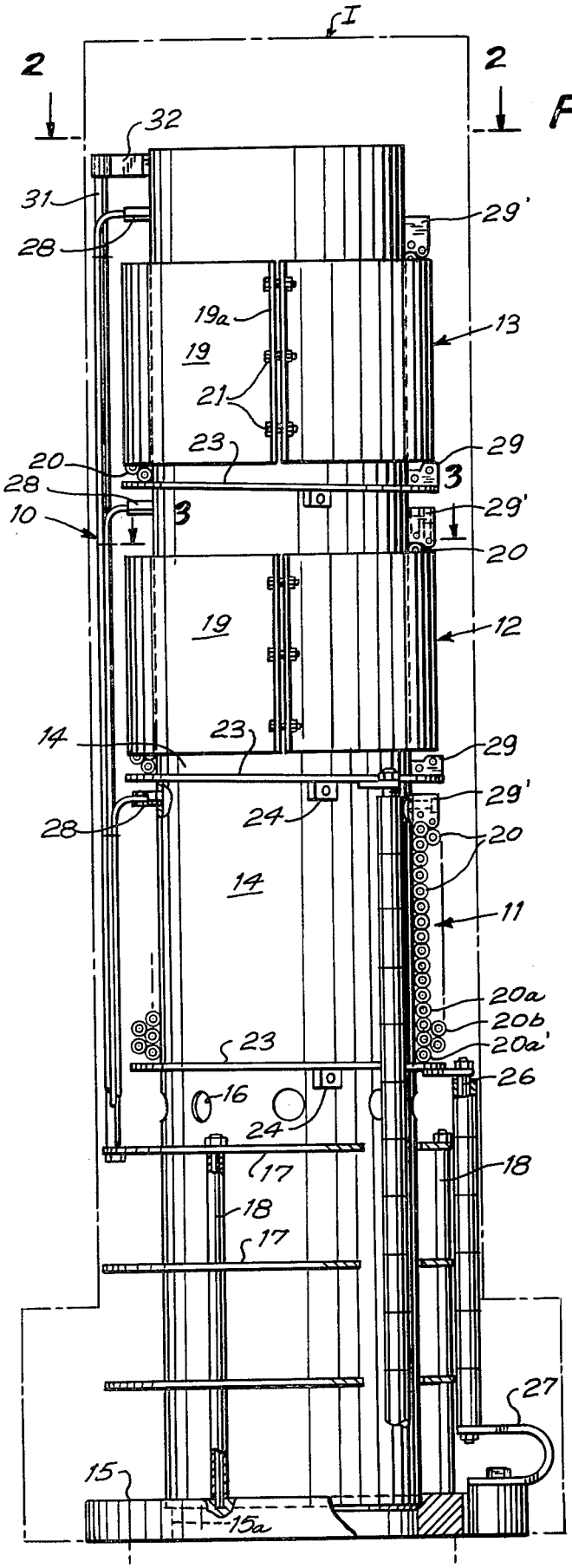
FIG.1
FIG.4
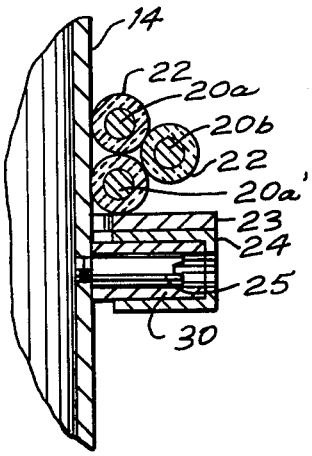

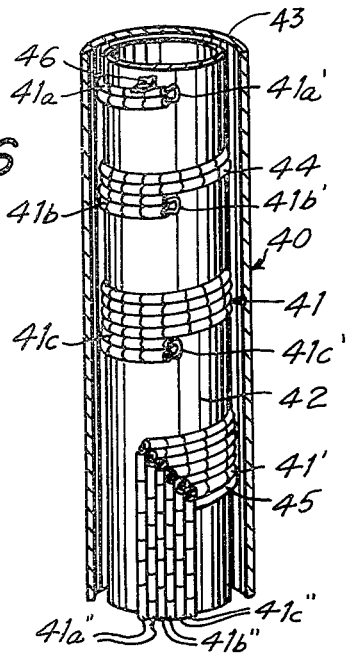
FIG.6
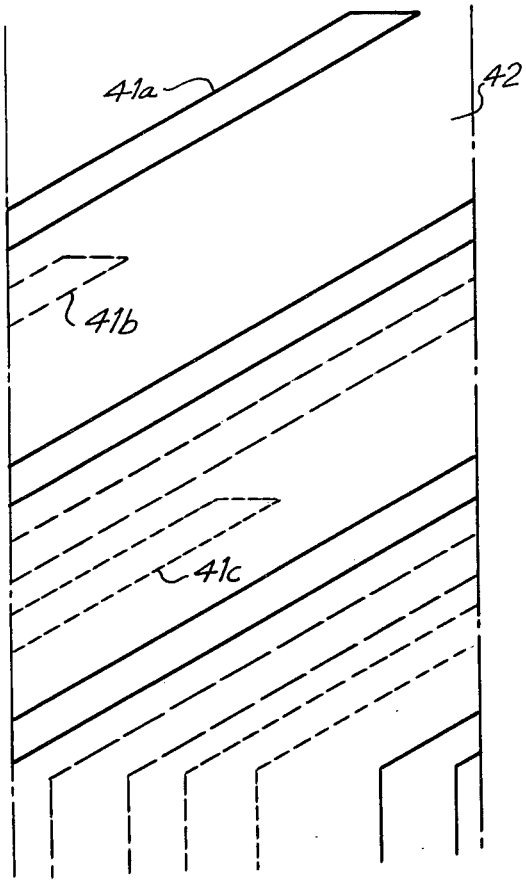
FIG.7
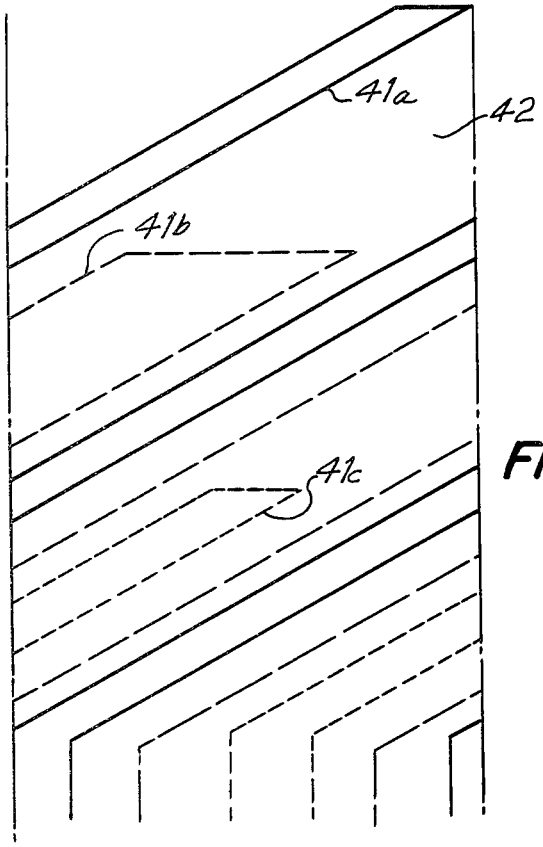
FIG.8
FIG.9
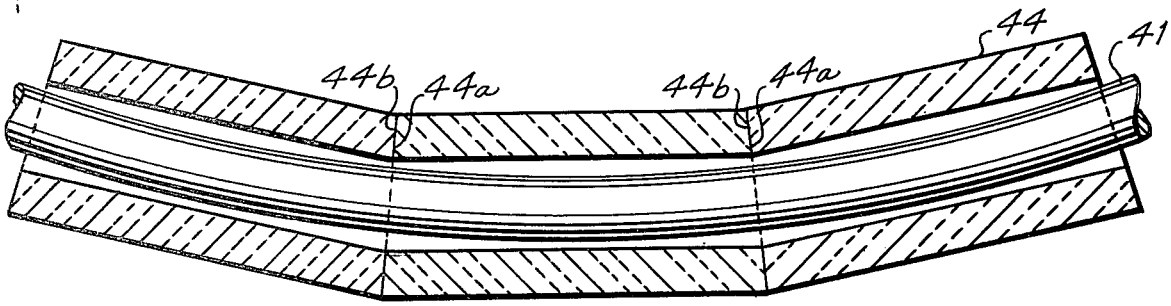

FURNACE ASSEMBLY

BACKGROUND OF THE INVENTION

This invention relates to a furance assembly for electrically heating a high temperature and high pressure process. This invention is particularly concerned with a multi-stage furnace assembly useful for hot isostatic pressing.

Electrically heated furnaces used in relatively large, high temperature (e.g., up to 3500° F) and high pressure (e.g., up to 50,000 p.s.i.), process vessels, such as hot isostatic presses, typically have been constructed as multi-stage furnaces. This has been done so that the heating of different stages or portions of the interiors of such high temperature and pressure, process vessels, along their longitudinal axes, can be independently varied. Being able to vary the heating of discrete stages of the furnaces has made it possible to compensate for the significant temperature differentials which generally occur in such process vessels, due principally to unequal heat losses from different portions of the process vessels and to non-uniform convection heat transfers between portions of the process vessels. As a result, one has been able to minimize the temperature fluctuations within process vessels, along the longitudinal axes thereof, under a wide variety of process conditions.

Multi-stage furnaces for high temperature and high pressure, process vessels generally have included a plurality of resistance heating elements. The resistance heating elements have been disposed in different stages of the furnaces, along the common longitudinal axes of the furnaces and their surrounding process vessels. The heating elements also have been provided with a separate power feed line to each heating element, separate means for regulating the power provided to each heating element, and separate temperature sensing devices for each stage of the furnaces containing a separate heating element. As a result, the multi-stage furnaces have been adapted to provide power inputs to the individual heating elements, in the different stages of the furnaces, sufficient for the varying temperature and power needs of the overall process operations being carried out and adjusted to correct any untoward temperature variations between stages of the furnaces. Hence, it has been possible with such multi-stage furnaces to carryout relatively large, high temperature and pressure, process operations with uniform temperature conditions in substantially all the stages of the process vessels being utilized.

However, serious problems have been encountered in constructing multi-stage furnaces having a plurality of resistance heating elements for process operations such as hot isostatic pressing. Typically, furnaces for such high temperature and high pressure processes have had to be designed to occupy only very limited spaces. This has been due to the extremely high cost of space in process vessels suited to high temperatures and pressures. Because of the severe space restrictions in high temperature, high pressure, process vessels, it has been very difficult to provide adequate structural support for all of the elements of the multi-stage furnaces. It also has been rather difficult to provide adequate electrical insulation for the separate resistance heating elements of the several stages of multi-stage furnaces and for the separate electrical feed lines to the heating elements in the restricted space available in such process vessels. Furthermore, it has been quite difficult to assemble such furnaces and, when necessary, to repair them because of the confined space in which the furnace elements have been located. Furnace assemblies have been sought therefore which are suitable for the multi-stage heating of high temperature, high pressure, process vessels and which occupy the minimum amount of space in the vessels consistent with proper electrical insulation and structural support for the furnace elements and ease of assembly and repair of the furnace elements.

Also because of the severe space restrictions in vessels for high temperature, high pressure processes, it has been extremely difficult to protect the elastomeric electrical insulation utilized for insulating electrical feed lines as they enter the process vessels from deterioration due to the high temperatures generated by the furnace assemblies in such vessels. Means have been sought therefore for keeping the streams of hot gases from the furance assemblies away from the elastomeric electrical insulation in the process vessels. Means also have been sought for minimizing the detrimental effects upon the elastomeric insulation of heat energy radiated from the heating elements of the furance assemblies.

SUMMARY OF THE INVENTION

In accordance with this invention, an electrically heated furnace assembly is provided, which comprises:

- a plurality of windings of a resistance heating element, helically wound about the longitudinal axis of the furnace assembly;
- a plurality of rigid insulating sleeves enclosing the heating element and substantially covering the surface of the heating element; the plurality of insulating sleeves abutting against the leading and trailing edges of one another and against the outer, upper and lower surfaces of one another; and
- a spiral shelf provided about the longitudinal axis of the furnace assembly, underlying the heating element and abutting against the outer lower surfaces of the insulating sleeves which enclose the lowermost winding of the heating element.

By the furnace assembly of this invention, heating, especially multi-stage heating, of a high temperature, high pressure, process vessel, such as a hot isostatic press, can be provided in a very limited space within the vessel. For multi-stage heating, this furnace can suitably include in a very limited space in a process vessel separate heating stages comprising a plurality of resistance heating elements having their own electrical power feed lines and variable sources of electrical power. Also for multi-stage heating, this furnace assembly can suitably include electrical power feed lines to the separate heating elements which enter the process vessel at the bottom thereof, beneath the lowermost heating stage of the furnace assembly, and means for protecting the elastomeric insulation associated with the feed lines from deterioration due to the heat generated by the furnace assembly.

In accordance with another aspect of this invention, a means is provided for protecting from deterioration due to heat the elastomeric insulation associated with the electrical power feed lines to the separate heating elements of a multi-stage furnace for a process vessel, wherein the feed lines enter the process vessel at its bottom, below the lowermost heating stage of the furnace, which comprises:

a plurality of baffle plates spaced along the longitudinal axis of the furnace assembly, between the lowermost heating element winding of the furnace assembly and the bottom of the furnace assembly; the baffle plates each having at least substantially the same surface area as the furnace assembly.

By this aspect of the furnace assembly of this invention, all the elastomeric electric insulation associated with feed lines to the resistance heating elements of the furnace are protected from the destructive effects of hot gases moving outwardly of the furnace assembly and the destructive effects of heat radiated from the heating elements of the furnace assembly.

BRIEF DESCRIPTION OF THE DRAWINGS

FIG. 1 is a plan view of a multi-stage, i.e., three stage, furnace assembly in accordance with this invention. The furnace assembly includes helical windings of three resistance heating elements, each provided in a separate stage of the furnace along its longitudinal axis. Portions of the furnace assembly have been cut-away to more clearly show the relationship of the furnace elements.

FIG. 4 is a fragmentary, enlarged, sectional view taken along line 4—4 in FIG. 3.

FIG. 6 is a schematic, perspective view of a portion of multi-stage, i.e., three stage, furnace assembly in accordance with an alternative embodiment of this invention. The furnace assembly includes helical windings of three resistance heating elements, all of which are provided in at least one of the three stages of the furnace along its longitudinal axis. A portion of the outer shell of the furnace assembly has been cut-away.

FIG. 7 is a schematic representation of a planer projection of the arrangement of the windings of resistance heating elements in the furnace assembly of FIG. 6. The individual heating elements are represented as dashed and solid lines.

FIG. 8 is a schematic representation of a planer projection of the arrangement of the windings of resistance heating elements for a multi-stage furnace assembly in accordance with an alternative embodiment of the windings in FIGS. 6 and 7.

FIG. 9 is a fragmentary, enlarged, sectional view of a portion of a winding of a resistance heating element and a plurality of insulating sleeves of this invention in the furnace assembly of FIG. 6.

DETAILED DESCRIPTION OF THE INVENTION

Figure 2:
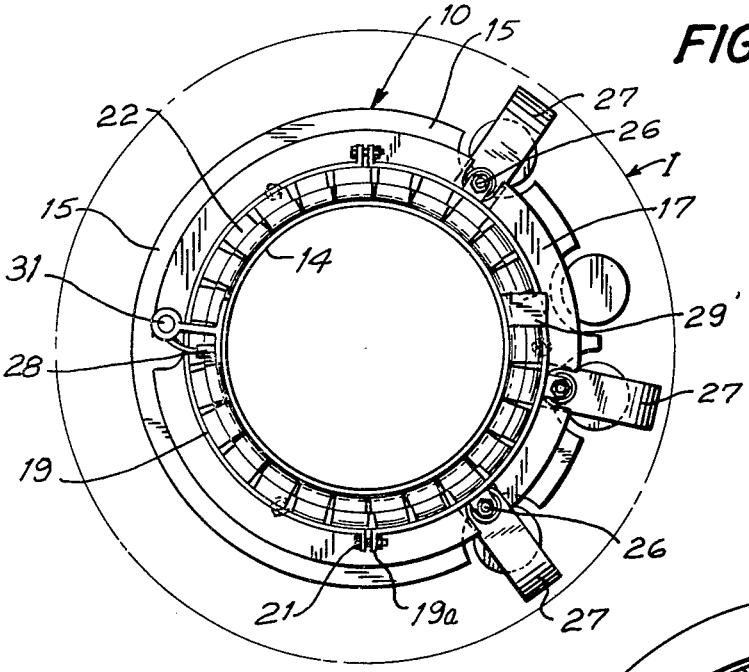
FIG. 2 is a sectional view taken along line 2—2 in FIG. 1.
Figure 3:
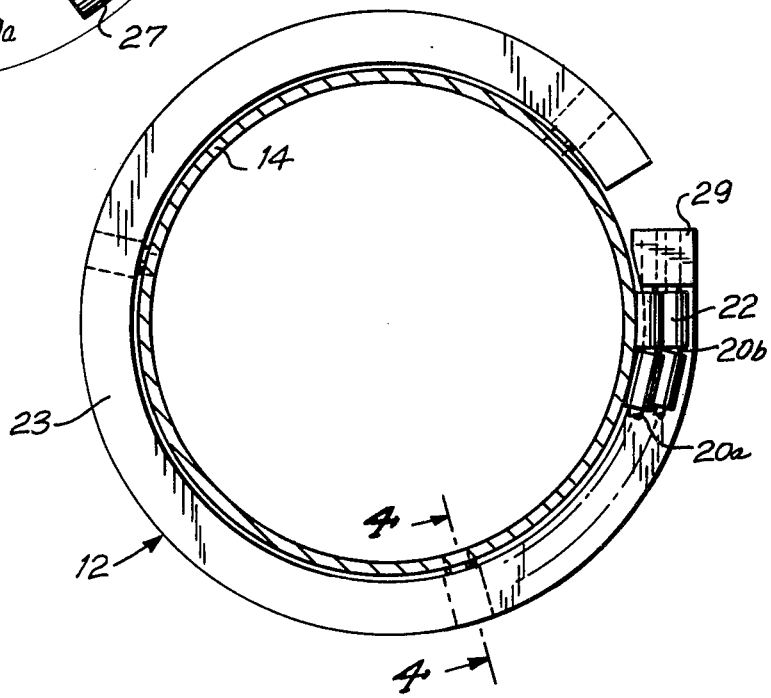
FIG. 3 is a sectional view taken along line 3—3 in FIG. 1.

In accordance with this invention, a multi-stage furnace assembly, generally 10, is shown in FIGS. 1 to 5. The furnace assembly 10 is mounted in a process vessel (not shown) suitable for high temperature and pressure, process conditions, such as a hot isostatic press. The insulating mantle I of the process vessel, within the pressure wall (not shown) of the process vessel is shown in outline in FIGS. 1 and 2. As seen from FIGS. 1 and 2, the furnace assembly 10 and its elements fit closely within the insulating mantle I and conform generally to the shape of the insulating mantle. As a result, the longitudinal axes of the furnace assembly 10 and of the insulating mantle I (and preferably of the pressure wall of the process vessel) are substantially coincident.

Preferably, the furnace assembly 10, the insulating mantle I, and the pressure wall which encloses them, when viewed from the top thereof, are substantially circular. However, if desired, the furnace assembly 10, the insulating mantle I and the pressure wall can have other configurations, when viewed from the top thereof, such as a square or elliptical configuration. Likewise, it is preferred that the elements, which will hereinafter be described, of the preferred, substantially circular, furnace assembly 10 be arranged in a substantially circular configuration about the longitudinal axis of the furnace assembly, when viewed from the top thereof. Hence, many of the elements of the furnace assembly 10 will be described as being generally tubular, generally circular, or wound in a circle about the longitudinal axis of the furnace assembly 10, in accordance with the preferred, substantially circular configuration of the elements of the furnace 10, when viewed from the top thereof. However, other configurations, e.g., square or elliptical, of the elements of the furnace assembly 10 about the furnace axis, generally conforming to the configuration of the insulating mantle I and the pressure wall enclosing them, also may be suitably utilized in accordance with this application.

As seen from FIG. 1, the furnace assembly 10 includes three separate heating stages or zones, i.e., a lower stage, generally 11, a middle stage, generally 12, and an upper stage, generally 13. Each heating stage 11–13 of the furnace 10 is arranged in a circle about the longitudinal axis of the furnace assembly, when viewed from the top of the furnace assembly. The heating stages 11–13 are adapted to permit the variable heating of different portions of the process vessel, within the insulating mantle I, along the longitudinal axes of the furnace assembly.

The furnace assembly 10 also includes a generally tubular, rigid inner shell 14, disposed in a circle about the longitudinal axis of the furnace assembly, when viewed from the top thereof. The heating stages 11–13 of the furnace assembly are positioned about the exterior of the inner shell 14. The inner shell 14, inter alia, is adapted to provide the principal structural support for the elements of the heating stages 11–13 of the furnace assembly 10 of FIGS. 1–5.

The inner shell 14 sits on the base plate 15 of the process vessel. The base plate 15 has a circular hole **15*a* in it about the longitudinal axis of the process vessel. Through the hole 15*a*, the hearth and the work can be inserted into the interior of the process vessel and into the inner shell 14 of the furnace assembly 10. The bottom of the inner shell 14 rests in a counter-bore in the base plate 15, about the hole 15*a* through the base plate. Thereby, the base plate 15 provides longitudinal support for the inner shell 14**.

The inner shell 14 has a plurality of holes 16 about its circumference, below the lower heating stage 11. The location of the holes 16 in the inner shell 14 is such that, when the work is inserted into the inner shell 14 on top of the hearth, the hearth is located just below the holes 16 in the inner shell 14.

The furnace assembly 10 further includes a plurality of, preferably three or more, generally circular, rigid baffle plates 17 located between the lower heating stage 11 and the base plate 15 of the process vessel. The baffle plates 17 are spaced apart along the longitudinal axis of the furnace assembly 10 and are disposed transverse to the furnace axis. The baffle plates 17 have at least substantially the same surface area as the furnace assembly, preferably a slightly smaller surface area than the cross-sectional area of the surrounding insulating mantle I, at the same point along the axis of the process vessel. The baffle plates 17 are rigidly mounted on a plurality of rigid common support rods 18. The support rods 18 are attached to the base plate 15 and are arranged in a circle about the longitudinal axis of the furnace assembly 10. The support rods 18 can be suitably attached to the base plate 15 in a conventionl manner, e.g., by providing the support rods 18 with threaded ends, adapted to be screwed into threaded holes in the base plate 15. Also in a conventional manner, spacer sleeves mounted about the support rods 18 can be used to keep the baffle plates 17 spaced apart along the furnace axis.

Each baffle plate 17 is provided with a hole at its center (not shown), substantially conforming to the exterior of the inner shell 14. The inner shell 14 is positioned within each such baffle plate hole and, thereby, is laterally supported by the baffle plates 17.

The furnace assembly 10 still further includes a relatively thin, generally tubular, outer shell 19 about each heating stage 11–13 (no outer shell 19 being shown about lower stage 11 in FIG. 1). Each outer shell 19 comprises two half-cylinders, with each half-cylinder having two lengthwise, outwardly flanged ends 19*a*. The outwardly flanged ends 19*a* of each pair of half-cylinders are adapted to be attached to form an almost continuous, tubular outer shell 19, wrapped in a circle about the inner shell 14 and the longitudinal axis of the furnace assembly 10, when viewed from the top of the furnace assembly 10. Each outer shell 19 encloses a plurality of windings of one or more resistance heating elements, generally 20, in each heating stage 11–13. The heating elements 20 are individually wound in a helix about the generally tubular, inner shell 14. The outer shell 19 for each stage 11–13 is especially adapted to hold the heating elements 20 snugly in place against the inner shell 14. For this purpose, a plurality of bolts 21 are utilized to tightly join the flanged ends 19*a* of the two half-cylinders of each outer shell 19. As a result, the inner and outer shells 14 and 19, in combination, comprise a means for laterally restraining the resistance heating elements 20, with their electrical insulation, as described below, in each stage 11–13.

The relationship of each of the one or more resistance heating elements 20 to each heating stage 11–13 of the multi-stage furnace assembly 10 of this application is best seen in the lower stage 11 of the furnace assembly, as shown in FIG. 1. In the lower stage 11, the outer shell 19 has been removed to show the cooperation of other elements in the stage 11. However, it should be realized that, in the furnace assembly 10 of this application, each of the plurality of stages 11–13 is provided with an outer shell 19 or its equivalent to hold the resistance heating elements 20 in place against the inner shell 14. Similarly, the discussion of the relationship of the other elements of the lower stage 11 in FIG. 1 is equally applicable to the relationship of the elements in the other stages 12 and 13 of the furnace assembly 10.

As particularly seen in the lower heating stage 11 of the furnace assembly 10, a pair of resistance heating elements 20*a* and 20*b* is provided in each stage 11–13. One of the heating elements 20*a* comprises a plurality of inner windings adjacent the inner shell 14. The other heating element 20*b* comprises a plurality of outer windings adjacent the outer shell 19. The resistance heating elements 20*a* and 20*b* are each wound about the inner shell 14 and the longitudinal axis of the furnace assembly as a helix. Hence, the windings of heating elements 20*a* and 20*b* appear to be wound in concentric circles about the furnace's axis when viewed from the top of the furnace. Both the inner and outer, helical windings of resistance heating elements 20*a* and 20*b* in each stage 11–13 cover the inner shell 14 along substantially the entire axial length of the furnace assembly 10 corresponding to the height of a stage. Also, each helical winding of a heating element is vertically aligned with the windings of the same heating element above and below it. Hence, the windings of each heating element 20*a* and 20*b*, with their electrical insulation as described below, form a generally tubular continuous surface about the furnace axis in each stage 11–13.

In the furnace assembly 10, a plurality of rigid, electrical insulating sleeves 22 are loosely strung over the helical windings of resistance heating elements 20. The insulating sleeves 22 enclose each heating element 20 and substantially cover its surface. The insulating sleeves 22 prevent any winding of a resistance heating element 20 from touching either another winding of the same heating element, a winding of another heating element or some other element of the furnace assembly 10, such as the inner and outer shells 14 and 19. Thereby, the danger of a short circuit occurring between the closely arranged elements of the furnace assembly 10 is virtually eliminated.

The inner resistance heating element 20*a* in each stage 11–13 is helically wound about the inner shell 14 so that the insulating sleeves 22 enclosing it abut against the inner shell 14. As a result, the insulating sleeves 22 on the windings of the inner resistance heating element 20*a* in each stage 11–13 also are substantially vertically aligned, and their outer, upper and lower surfaces abut. Similarly, the outer resistance heating element 20*b* in each stage is helically wound about the inner heating element 20*a* so that the insulating sleeves 22 enclosing the outer heating element 20*b* abut against the insulating sleeves 22 covering the windings of the inner heating element 20*a*. As a result, the insulating sleeves 22 on the outer resistance heating element 20*b* in each stage also are substantially vertically aligned, and their outer, upper and lower surfaces abut.

Figure 5:
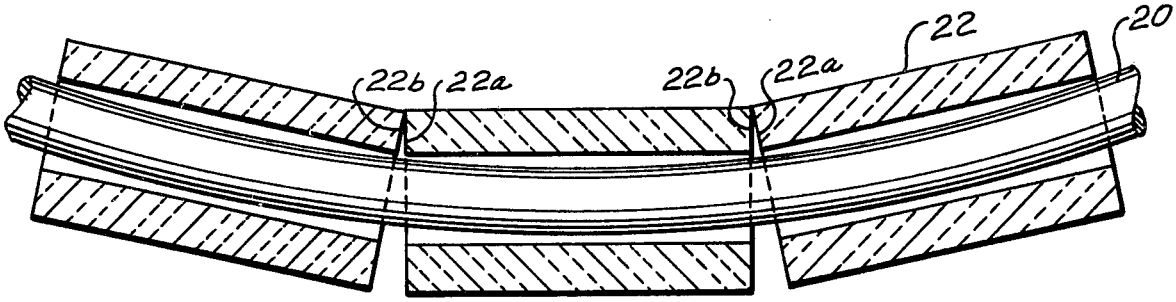
FIG. 5 is a fragmentary, enlarged, sectional view of a portion of a winding of a resistance heating element and a plurality of insulating sleeves of this invention in the furnace assembly of FIG. 1.

As seen in FIGS. 2 and 5, the plurality of insulating sleeves 22 are strung very closely together on the helical windings of the resistance heating elements 20. As a result, the plurality of insulating sleeves 22 abut against the leading and trailing edges 22*a* and 22*b* of one another.

Underlying the helical windings of resistance heating elements 20 in each heating stage 11–13 of the furnace assembly 10 is a continuous spiral shelf 23. The spiral shelf in each stage 11–13 winds at least about once around the longitudinal axis of the furnace assembly 10. The winding of each spiral shelf 23 about the longitudinal axis of the furnace assembly 10 appears circular when viewed from the top of the furnace 10. Each spiral shelf 23 also winds about but is spaced from the exterior surface of the inner shell 14. Each spiral shelf 23 abuts against the outer lower surfaces of the insulating sleeves 22 which enclose the lowermost winding of a resistance heating element 20 in each stage 11–13, e.g., the lowermost winding 20*a'* of heating element 20*a* in the lower stage 11 in FIG. 1. The shelf 23 is adapted to provide longitudinal support for the plurality of windings of heating elements 20 and their insulating sleeves 22 in each heating stage 11–13.

In the furnace assemblies of this application, the spiral shelf 23 can be a continuous shelf or can be segmented. All that is required is that the spiral shelf 23 provide support for the one or more resistance heating elements 20 and the insulating sleeves 22, on the heating elements 20, in each heating stage 11–13 of the furnace assembly. Also in the furnaces of this application, the extent to which the spiral shelf 23 winds about the longitudinal axis of the furnace assembly 10 and, hence, about the inner shell 14 is not critical. Preferably, each spiral shelf 23 extends at least 360° about the axis of the furnace assembly. However, the spiral shelf 23 also can extend somewhat less than 360° about the furnace axis without the heating elements 20 sagging or tending to fall out from between the inner and outer shells 14 and 19. Further in the furnace assembly 10, the spiral shelf 23 can, if desired, wind more than once, e.g., twice or thrice, about the furnace axis. However, more than about one complete winding, i.e., 360°, of the spiral shelf about the inner shell 14 and the furnace axis is considered superfluous.

Mounted under each spiral shelf 23 are a plurality of support blocks 24. The support blocks 24 are shown in detail in FIG. 4. The support blocks are fastened to the inner shell 14 by means of threaded shelf retaining pins 25 and provide longitudinal support for the spiral shelves 23.

Each spiral shelf 23 of a heating stage 11–13 also is attached to a separate electrical power feed line 26. The feed lines 26 are enclosed within a plurality of insulating elements, such as the insulating sleeves 22 which enclose the resistance heating elements 20. Each electrical feed line 26 to a stage 11–13 is connected, through a bus bar 27, to a separately controlled source of electrical power outside of the process vessel (not shown). The feed lines 26 enter at the bottom of the furnace 10 and the process vessel and pass upwardly in the furnace through the baffle plates 17 to the spiral shelves 23 of the heating stages 11–13.

That the feed lines 26 connected to the separate sources of electrical power for the heating stages 11–13 enter at the bottom of the process vessel and the furnace assembly 10 is considered a special advantage provided by the furnace of this application. It allows the heat sensitive, elastomeric insulation which covers the feed lines 26 at their entrance to the process vessel to be protected from the effects of circulating hot gases and radiated heat from the heating stages 11–13 of the furnace. This is accomplished by providing the baffle plates 17 which extend across the furnace assembly 10 between: the lower stage 11 and the lowermost heating element winding 20*a'* of the furnace; and the bottom of the furnace, at the process vessel base plate 15. The baffle plates 17 are provided with a plurality of holes that are only large enough to accommodate: the inner shell 14, as discussed above; the support rods 18; and the electrical feed lines 26, with their insulating sleeves, that are connected to the spiral shelves 23. As a result, the baffle plates 17 substantially prevent hot gases from the heating stages 11–13 from circulating to the bottom of the furnace assembly 10, where they could adversely affect the elastomeric insulation covering electrical feed lines entering the process vessel. More importantly, the baffle plates 17 deflect heat radiated by the heating elements of the furnace assembly 10 away from the bottom of the process vessel. Thereby, the elastomeric insulation is protected from the deleterious effects of radiated heat generated by the furnace assembly 10.

Also provided in the furnace assembly 10 are a plurality of temperature sensing devices 28, such as thermocouples. The temperature sensing devices 28 can be utilized to determine the temperature in each stage 11–13 of the furnace assembly 10. From such temperature determinations, the power to the resistance heating elements 20 in any stage can be adjusted to provide a more uniform axial temperature in the furnace assembly 10 and within the insulating mantle I of the process vessel.

In the preferred furnace assembly of FIG. 1, an electrically conductive spiral shelf 23 is provided in each heating stage 11–13, and electrical power from the electrical feed lines 26 is conducted to the resistance heating elements 20 in the stages 11–13 through the spiral shelves 23. For this purpose, in each heating stage 11–13, one end of each feed line 26 is connected to the spiral shelf 23, and each heating element 20 is connected at its lower end to an electrically conductive socket 29, mounted on the spiral shelf 23. The shelf mounted sockets 29 comprise conventional sockets adapted to conduct electrical power between the electrically conductive shelf 23 and an end of a resistance heating element 20. Also provided in each heating stage 11–13 of the preferred furnace assembly 10, shown in FIG. 1, is an electrically conductive socket 29' mounted on the inner shell 14 and connected to the other, upper end of each resistance heating element 20 in each stage 11–13. The inner shell mounted sockets 29' comprise conventional sockets adapted to conduct electrical power between the ends of each resistance heating element 20 and a conductive inner shell 14. When utilizing inner shell mounted sockets 29' in communication with the ends of the resistance heating elements 20, it is essential that the inner shell 14 be made of an electrically conductive material having good structural strength at the temperatures and pressures utilized, such as low carbon steel or stainless steel. In the furnace assembly 10, one or more shelf mounted sockets 29 and one or more inner shell mounted sockets 29' can be utilized in each stage 11–13, depending upon the number of heating elements 20 in the stages. Preferably, however, a single common shelf mounted socket 29 and a single common inner shell mounted socket 29' are utilized in each stage 11–13 regardless of the number of heating elements 20 in each stage.

In the preferred furnace assembly of FIG. 1, wherein electrically conductive sockets 29 and 29' are utilized in combination with electrically conductive spiral shelves 23 and an electrically conductive inner shell 14, it is considered essential that the support blocks 24 be electrically insulated from the inner shell 14. For this purpose, electrically non-conductive, cylindrical inserts 30 are provided in the support blocks 24 surrounding the shelf retaining pins 25.

Further provided in the furnace assembly 10 of FIG. 1 is an additional support rod 31, attached to the inner shell 14 and the uppermost baffle plate 17. The additional support rod 31 is adapted to hold-up the temperature sensing devices 28 that are located in each heating stage 11–13. The additional support rod 31 can be attached to the inner shell 14 and the uppermost baffle plate 17 in a conventional manner. Where an electrically conductive inner shell 14 is utilized in combination with electrically conductive spiral shelves 23 and inner shell mounted sockets 29' and shelf mounted socket 29, it is considered important that the additional support rod 31 be electrically insulated from the inner shell 14, as by use of an electrically non-conductive bracket 32, connected to the additional rod 31 and the inner shell 14.

In the furnace assembly 10 of this application and the process vessel associated with the furnace assembly, certain elements have not been shown in the Drawings. For example, the interior surface of the insulating mantle I only has been shown in outline, and the pressure wall of the process vessel has not been specifically shown. Also, not all of the windings of the resistance heating elements 20, provided over substantially the entire height of each heating stage 11–13, have been shown in the Drawings of stages 11–13 of the furnace assembly 10. Further, the electrical feed lines 26 connected to the spiral shelves 23 of the middle and upper stages 12 and 13 and their connection to the spiral shelves 23 and to sources of electrical power, via the bus bars 27, have not been shown. However, it is to be understood that, with respect to all of these elements which have not been specifically shown in the Drawings, their structure and relationship to the heating stages 11–13 of the furnace assembly 10 correspond with those of the same elements that are specifically shown in the Drawings.

The resistance heating elements 20 of the furnace assembly 10 can comprise any conventional metal or alloy useful as heating elements for high temperature, electrically heated furnaces. Among such heating elements are included molybdenum, tungsten, iron, nickel, platinum, aluminum, chromium, cobalt, and alloys of these metals.

The inner shell 14 and the outer shell 19 as well as the spiral shelves 23, support rods 18 and 31, bolts 21, and baffle plates 17 of the furnace assembly 10 can comprise any structurally stable material conventionally utilized in furnace assemblies for high temperature, high pressure, process vessels, such as hot isostatic presses. For example, they can be made of a low carbon steel or stainless steel, with stainless steel being the preferred material.

The insulating sleeves 22 can be made from any conventional rigid material which is stable at high temperatures and pressures and which provides, at the shell thicknesses utilized, adequate electrical insulation for the resistance heating elements 20. Among the materials which can be suitably utilized are included alumina and mullite, with high purity alumina being the preferred material.

The shape of the insulating sleeves 22 of this application is not critical. The insulating sleeves 22 suitably can be generally spherical or generally tubular. The insulating sleeves 22 also can suitably have interior and exterior surfaces with a circular or an elliptical configuration in cross-section, as well as a polygonal configuration in cross-section, such as a square or a pentagonal configuration. All that is required is that the cross-sectional shape of the interior and exterior surfaces of the insulating sleeves 22 allow the sleeves to be strung over the resistance heating elements 20 to enclose and substantially cover the heating elements; permit the resistance heating elements 20 enclosed in such insulating sleeves 22 to be closely wound, in a plurality of windings, about the inner shell 14; and allow the insulating sleeves 22, as wound about the inner shell 14 on a heating element 20, to abut against the leading and trailing edges of one another and against the outer, upper and lower surfaces of one another. The preferred, rigid insulating sleeves 22 of this application are substantially cylindrical and have either planer ends 22*a* and 22*b*, as shown in FIG. 5, or one end concave and the other end convex, as in FIG. 9.

In the furnace assembly 10 of this invention, particular dimensions and quantities of the furnace elements, e.g., the diameter, length and number of windings of the resistance heating elements 20, are not considered critical However, the dimensions of the insulating sleeves 22 as compared with the diameter of the inner shell 14 and the thickness of the resistance heating elements 20 are considered quite important. The length of the insulating sleeves 22 should be sufficiently small so that at least about 20, preferably 25 to 40, of them are utilized in each winding of a heating element 20 about the furnace axis. In this way, each winding of a heating element 20 is substantially circular and hence occupies the minimum amount of space between the tubular inner and outer shells 14 and 19. Also in this way, the exposed surface area of the heating elements 20, between adjacent insulating sleeves 22 on the same winding, is minimized. The inside diameter of the sleeves 22 should be sufficiently large to accomodate the thickness of the heating elements 20 and expansion of the heating elements with increasing furnace temperatures. The outside diameter of the insulating sleeves 22 should be sufficiently large to provide a wall thickness of the sleeves adequate to prevent exposed portions of the heating elements 20, between adjacent insulating sleeves 22, from contacting other furnace elements and to prevent arcing from occurring between such exposed portions of the heating elements 20 and other furnace elements. The thickness of the walls of the insulating sleeves 22 is particularly important when the heating elements 20 expand at the higher operating temperatures of the furnace 10 and, as a result, increased portions of the heating elements 20, between adjacent insulating sleeves 22, are outside of the coverage of the insulating sleeves. The walls of the insulating sleeves 22 also should be thick enough to provide sufficient strength to the insulating sleeves 22 that enclose the lowermost winding of heating elements 20 in each heating stage 11–13 and support the weight of the helical stack of windings of heating elements 20 and insulating sleeves 22 above them.

The supportive strength of the insulating sleeves 22 is particularly important in a furnace assembly 10 of this application intended for use in a vessel such as a hot isostatic press. This is because, at the very high operating temperatures of such a furnace, conventional heating elements have greatly diminished tensile strengths and, hence, are prone to fail under their own weight. However, in accordance with this application, commercially available, rigid cylindrical insulating sleeves 22 made of very pure alumina can be used to provide direct support for helically wound heating elements over substantially the entire length of each heating element, with a significantly decreased danger that unsupported portions of the heating elements will sag and break at very high temperatures. For example, alumina insulating sleeves 22 having a length of ¾ inch, an inside diameter of ¼ inch and an outside diameter of ⅜ inch can be suitably utilized in a multi-stage furnace assembly 10 of this application with two heating elements 20*a* and 20*b* in each stage having a thickness of 0.204 inches, an inner winding diameter of about 7 inches, an outer winding diameter of about 7⅝ inches, and about 16 windings per heating element.

In the multi-stage furnace assembly 10, the use of three separate heating stages 11–13 and the use of two resistance heating elements 20*a* and 20*b* in each stage are preferred. However, the number of stages and the number of resistance heating elements utilized in the stages of any furnace of this application are not considered critical, and greater or lesser numbers of these elements may be suitably utilized for providing furnace assemblies, especially multi-stage furnace assemblies, in the minimum amount of space. In fact, the furnace assemblies of this application comprehend both single stage and multi-stage furnace assemblies, similar to furnace assembly 10, in which are provided at least one heating stage 11–13 which includes: helical windings of one or more resistance heating elements 20, insulating sleeves 22 enclosing the heating elements and substantially covering their surfaces; and an underlying spiral shelf 23 of this application. Hence, the furnaces of this application could, if desired, include, for example, up to five heating stages, with each stage including windings of up to three resistance heating elements, insulating sleeves enclosing the heating elements, and an underlying spiral shelf.

In the operation of the furnace assembly 10, electrical power is provided to heat one or all or a combination of the stages 11–13 of the furnace 10. The electrical power is fed to each stage via the bus bar 27 and the electrical feed line 26 connected to each stage being heated. The quantity of power provided to each stage is regulated to provide a uniform axial temperature within the furnace assembly 10 and the insulating mantle I of the process vessel. The electrical power through the feed lines 26 is conducted to the resistance heating elements 20 in each stage through the spiral shelf 23 and through the shelf mounted sockets 29. The return path of the electrical current, as it leaves the heating elements 20, is through the inner shell mounted sockets 29' and through the inner shell 14. The inner shell 14 serves as a common return to the base plate 15 and the process vessel, which act as ground.

During the operation of the furnace assembly 10, the pressurized gas in the process vessel is free to move within the insulating mantle I of the process vessel and into and out of the space occupied by the furnace assembly 10. For example, convection currents of relatively cool, pressurized gas can move through the holes 16, located below the lowermost heating element winding 20*a'*, into the interior of inner shell 14. Likewise, convection currents of relatively hot gas can move up the interior of the inner shell 14, past the upper stage 13, and to the exterior of the furnace assembly 10, adjacent its outer shells 19. However, the presence of the baffle plates 17, beneath the lower stage 11, besides deflecting radiated heat away from the bottom of the furnace assembly 10, effectively prevents the heated gases produced in the furnace 10 from circulating in the bottom of the furnace. Thereby, any possible adverse effects of the high temperatures produced by the furnace assembly upon the elements in the bottom of the furnace 10, particularly the bus bar 27, the feed lines 26 to the stages 11–13, and the elastomeric insulation associated with the electrical feed lines entering the process vessel and connected to the bus bars 27, are effectively minimized.

Shown in FIG. 6 is a schematic, perspective view of a multi-stage furnace assembly 40, in accordance with an alternative embodiment of this invention, for a high temperature, high pressure, process vessel. The furnace assembly 40 includes a plurality of resistance heating elements, generally 41, wound in a helix about a generally tubular, rigid inner shell 42. Surrounding the heating elements 41 and the inner shell 42 is a generally tubular, outer shell 43. Strung loosely over each of the heating elements 41 are a plurality of rigid insulating sleeves 44. The insulating sleeves 44 enclose the heating elements 41 and substantially cover their surfaces. As seen in FIG. 9, the insulating sleeves are strung closely together over the heating elements 41 so that their leading and trailing edges 44*a* and 44*b* abut. Underlying the heating element windings and mounted on the inner shell 42 is a spiral shelf 45.

In the furnace assembly 40, when viewed from the top thereof, as in furnace 10, the helical windings of resistance heating elements 41, the inner and outer shells 42 and 43, and the spiral shelf 45 preferably have a generally circular configuration about the longitudinal axis of the furnace. However, also as in furnace 10, other configurations, e.g., square or elliptical, may be utilized in the elements of the furnace 40 depending upon the configuration of the surrounding process vessel and its insulating mantle and pressure wall (not shown in FIG. 6), when viewed from the top thereof.

Each of the resistance heating elements 41 of the furnace assembly 40 comprises a length of a heating element that is folded in the middle into an elongated U-shaped member. The U-shaped heating elements then are helically wound together several times about the inner shell 42 of the furnace assembly 40. As wound about the inner shell 42, each heating element 41 forms an upwardly extending, bifurcated helix, with the two ends of the heating element being located at the bottom of the furnace 40. Because the heating elements are wound together, the bifurcated helixes are intermeshed about the inner shell 42. In FIG. 6, three intermeshed, bifurcated helical heating elements 41*a*, 41*b*, and 41*c* are provided. The three heating elements 41*a*–41*c* are of substantially different lengths and include different numbers of windings about the inner shell 42. The heating elements 41*a*–41*c* also extend along different axial lengths of the inner shell 42.

The three intermeshed bifurcated resistance heating elements 41*a*–41*c* define three distinct heating stages or zones in the furnace assembly 40. One stage contains all three heating elements, one stage contains two of them, and one stage contains only one of them. The three stages can be utilized for regulating the heating of and the temperature in the furnace assembly 40 of FIG. 6. For purposes of this description, the three heating stages in the furnace assembly 40 may be considered as: an upper stage between the U-shaped bend 41*a'* in the longest heating element 41*a* and the U-shaped bend 41*b'* in the second longest heating element 41*b*; a middle stage between the U-shaped bend 41*b'* in the second longest heating element 41*b* and the U-shaped bend 41*c'* in the shortest heating element 41*c*; and a lower stage between the U-shaped bend 41*c'* in the shortest heating element 41*c* and the lowest winding of a heating element 41 about the inner shell 42.

The bifurcated resistance heating elements 41 and the insulating sleeves 44, which enclose them, are supported by the single spiral shelf 45. The spiral shelf 45 underlies the lowermost winding 41' of the resistance heating elements 41 and abuts against the outer lower surfaces of the insulating sleeves 44 enclosing the lowermost winding 41'. The spiral shelf 45 also abuts against the inner shell 42 and is spirally wound about it. The spiral shelf 45 can be continuous or segmented, and it can extend once or more about the inner shell 42. The spiral shelf 43 preferably extends about 360° about the longitudinal axis of the furnace assembly 40.

Each of the resistance heating elements 41*a*–41*c* in the furnace assembly 40 is provided with a straight portion 41*a*''–41*c*'' at its ends. The straight portions 41*a*''–41*c*'' of each heating element extend directly to the bottom portions of the furnace assembly 40 (not shown) and to power feed lines and return paths, as in the furnace assembly 10 of FIG. 1.

Schematically shown in FIG. 7 is a planer projection of the resistance heating elements of FIG. 6 as wound about the inner shell 42. Schematically shown in FIG. 8 is a planer projection of an alternative method of winding the three resistance heating elements 41*a*–41*c* about the inner shell 42 to provide a multi-stage furnace having three distinct stages for temperature control in the furnace assembly 40.

In furnace assembly 40, the three restistance heating elements 41*a*–41*c*, in combination, cover the inner shell 42 along a substantial length. The intermeshed bifurcated helical windings of resistance heating elements 41*a*–41*c* also are vertically aligned along the length of the inner shell 42. As a result, the heating elements 41*a*–41*c*, with their coverings of insulating sleeves 44, form a generally tubular, continuous surface about the furnace axis.

Also in furnace 40, one thickness of windings of the three heating elements 41*a*–41*c* is provided between the inner and outer shells 42 and 43 of the furnace 40, although two or more thicknesses of windings could, if desired, be provided. The insulating sleeves 44 and their enclosed windings of resistance heating elements 41 are held snugly against the inner shell 42 by the close fitting outer shell 43. The plurality of insulating sleeves 44 on the heating elements 41 also abut against the outer, upper and lower surfaces of one another, and the insulating sleeves on the lowermost heating element winding 41' abut against the spiral shelf 45. Thus, the insulating sleeves 44 and hence the heating elements within them are laterally restrained by the inner and outer shells 42 and 43 and are longitudinally supported by the spiral shelf 45.

In the multi-stage furnace assembly 40, as in the furnace 10, the use of three separate heating stages provided by three resistance heating elements 41*a*–41*c* is preferred. However, the number of stages and heating elements is not critical, and greater or lesser numbers of stages and heating elements may be utilized to provide a furnace, especially a multi-stage furnace, in the minimum amount of space. In fact, the furnace assemblies of this application comprehend both single stage and multi-stage furnaces, like furnace 40, in which are provided at least one heating stage, which includes: helical windings of one or more resistance heating elements 41; insulating sleeves 44 enclosing the heating elements and substantially covering their surfaces; and a spiral shelf 45 underlying the heating elements and abutting against the outer lower surfaces of the insulating sleeves which enclose the lowermost heating element winding.

Not shown in FIGS. 6, 7 or 8 are all of the plurality of windings for each heating element 41*a*–41*c*. However, in each stage of the furnace assembly 40 of this invention, as in the furnace assembly 10, the inner shell 42 preferably is almost completely surrounded by a continuous surface formed by the windings of the heating elements 41 and their insulating sleeves 44 and having the cross-sectional configuration of the inner shell 42. Nevertheless, for ease of understanding, not all the windings of the heating elements 41 have been shown in FIGS. 6 to 8.

The resistance heating elements 41 and the insulating sleeves 44 in the furnace assembly 40 can be made of the same materials and have the same configurations and dimensions as the corresponding elements in the furnace assembly 10 in FIG. 1. Also in furnace assembly 40, as in furnace assembly 10, the number of heating elements and stages provided is not critical and can comprise one or a plurality in accordance with this invention. Further, the distribution of the heating elements among the stages of furnace 40 is not critical, and any stage can suitably include one or more separate heating elements, depending upon the temperature control procedure to be used in the furnace. Likewise, the inner and outer shells 42 and 43 and the spiral shelf 45 of the furnace assembly 40 can be made of the same materials and have the same configurations as the corresponding inner and outer shells 14 and 19 and spiral shelf 23 of the furnace assembly 10. The furnace assembly 40 also can be provided, if desired, with temperature sensing devices 28, as in furnace 10, and a bottom construction, below its lowermost heating element winding, similar to that of furnace 10, containing baffle plates 17, support rods 18 and 31, a base plate 15, feed lines 26 to the heating elements, bus bars 27, and holes 16 in the inner shell.

The furnace assembly 40 of FIG. 6, like furnace 10 of FIG. 1, is well suited for providing a uniform temperature in a hot isostatic press. By regulating the power provided to the several resistance heating elements 41 of the furnace assembly 40, heating of the upper, middle and lower stages of the furnace assembly can be adjusted to assure a uniform temperature distribution along the longitudinal axis of the furnace assembly and the insulating mantle surrounding it.

A particularly important feature of both the furnace assembly 10 of FIG. 1 and the furnace assembly 40 of FIG. 6 is that they can accommodate both radial and lengthwise expansion of the windings of resistance heating elements 20 and 41 and provide support for the windings as the windings expand. This is essential at high temperatures where resistance heating elements typically become very weak. Unless the heating elements are supported as they expand, particularly as they expand lengthwise, the expanded portions of the heating elements are likely to break of their own weight.

However, such failure of the heating elements 20 and 41 in the furnace assemblies 10 and 40 of this application at high temperatures is substantially prevented. The vertically aligned stacks of insulating sleeves 22 and 44 loosely enclose the heating elements 20 and 41 and allow the heating elements to fully expand radially within the insulating sleeves. More importantly, lengthwise expansion of the heating elements 20 and 41 is substantially accommodated by the radial expansion of the generally tubular, inner and outer shells 14, 19, 42, and 43. As the heating elements expand lengthwise, the inner and outer shells expand radially, with the result that the heating elements do not move significantly relative to the inner and outer shells. Hence, the insulating sleeves are continuously laterally restrained and longitudinally supported by their abutting relationships with the outer, upper and lower surfaces of one another, the underlying spiral shelves 23 and 45, and the inner and outer shells of the furnaces. At very high temperatures in the furnaces, the insulating sleeves 22 and 44 may no longer abut against the leading and trailing edges of one another due to the lengthwise expansion of the heating elements. However, this change in the abutting relationship of the insulating sleeves does not seriously affect their longitudinal support of the heating elements. This is because the maximum gap between the ends of the insulating sleeves, even at the highest operating temperatures of the furnace assemblies, is very small. As a result, the heating elements are substantially and continuously supported by the surrounding insulating sleeves, even at very high furnace temperatures. Thus, the radial and lengthwise expansion of the windings of the heating elements of the furnaces 10 and 40 can be controlled at high temperatures, and the weight of the heating elements and their insulating sleeves can be fully supported by the insulating sleeves.

In the furnace assembly 40 of this application, depending upon its design, lengthwise expansion of the heating elements 41 at elevated temperatures also can result in small movements of the U-shaped bends 41*a'*–41*c'* of the heating elements axially upward of the furnace assembly 40. For example, movement of the U-shaped heating element bends 41*a'*–41*c'* could occur if expansion of the outer shell 43 were significantly less than the expansion of the heating elements 41. In such a case, the use of a retaining tab 46, provided directly above the heating elements and projecting from the outer surface of the inner shell 42, is preferred in furnace 40. The tab 46 keeps upward movement of the uppermost winding of the longest heating element 41*a* along the surface of the inner shell 42 and in a helix about the furnace axis. The uppermost winding of the longest heating element 41*a* and hence all the windings of the other heating elements below it are thereby prevented from upward movement, parallel to the furnace axis. As a result, lengthwise expansion of all of the individual heating elements 41*a*–41*c* of the furnace 40 can be restricted by the retaining tab 46 to winding movement of the heating elements in a helix about the inner shell 42.

An additional important aspect of the lateral restraint and longitudinal support provided to the heating elements 20 and 41 by the insulating sleeves 22 and 44, over a wide range of operating conditions of the furnace assemblies 10 and 40, is provided by the abutment of the insulating sleeves at their leading and trailing edges. Besides assuring that the heating elements are substantially covered by the insulating sleeves, the abutment of the leading and trailing edges of the insulating sleeves also can restrain angular displacement of adjacent sleeves with respect to one another.

That the rigid insulating sleeves 22 and 44 of this application serve the dual functions of providing needed electrical insulation for one or more resistance heating elements and feed lines in a furnace as well as providing substantial structural support for the resistance heating elements is considered quite advantageous. This is particularly true in multi-stage furnaces for process vessels such as hot isostatic presses, in which the space available for heating elements, electrical insulation and structural support members, as well as for access to the various elements for assembly and repair purposes, is extremely limited.

That, during thermal expansion of the heating elements, movement of the heating elements of the furnace assemblies of this application can be accommodated while continuously supporting the heating elements also is considered quite advantageous. Thereby, the need for extensive and costly means for supporting various portions of the heating elements, as they expand and weaken at elevated temperatures in the furnace assemblies, can be avoided.

It is thought that the invention and many of its attendant advantages will be understood from the foregoing description and it will be apparent that various changes may be made in the form, construction and arrangement of the parts without departing from the spirit and scope of the invention or sacrificing all of its material advantages, the forms hereinbefore described merely preferred embodiments thereof.

We claim:

1. An electrically heated furnace assembly, which comprises:

an inner shell, disposed about the longitudinal axis of the furnace assembly;

a plurality of windings of a resistance heating element, helically wound about the longitudinal axis of the furnace assembly and about the inner shell;

a plurality of rigid insulating sleeves enclosing the heating element and substantially covering the surface of the heating element; the plurality of insulating sleeves abutting against the leading and trailing edges of one another, against the outer, upper and lower surfaces of one another, and against the inner shell;

an outer shell; disposed about the longitudinal axis of the furnace assembly and about the inner shell and adapted to hold the insulating sleeves on the heating element against the inner shell; and a spiral shelf provided about the longitudinal axis of the furnace assembly and about the inner shell, underlying the heating element and abutting against the outer lower surfaces of the insulating sleeves which enclose the lowermost winding of the heating element.

2. The furnace assembly of claim 1 having a plurality of separate heating stages, each stage being provided with:

an inner shell, disposed about the longitudinal axis of the furnace assembly;

a resistance heating element; helically wound about the longitudinal axis of the furnace assembly and about the inner shell;

a plurality of the rigid insulating sleeves enclosing each heating element and substantially covering the surface of each heating element; the plurality of insulating sleeves abutting against the leading and trailing edges of one another, against the outer, upper and lower surfaces of one another and against the inner shell;

an outer shell, disposed about the longitudinal axis of the furnace assembly and about the inner shell and adapted to hold the insulating sleeves on the heating element against the inner shell; and a spiral shelf provided about the longitudinal axis of the furnace assembly and about the inner shell, underlying the heating element in each stage and abutting against the outer lower surfaces of the insulating sleeves which enclose the lowermost heating element winding in each stage.

3. The furnace assembly of claim 2 wherein each spiral shelf is made of an electrically conductive material and is connected to an electrical power feed line.

4. The furnace assembly of claim 3 wherein one end of the resistance heating element in each stage is electrically connected to the electrically conductive spiral shelf in each stage.

5. The furnace assembly of claim 2 wherein the resistance heating element in each stage is helically wound about a common, generally tubular, inner shell located about the longitudinal axis of the furnace assembly.

6. The furnace assembly of claim 5 wherein the inner shell is made of an electrically conductive material and an end of the resistance heating element in each stage is electrically connected to the inner shell.

7. The furnace assembly of claim 6 wherein the spiral shelf in each stage is made of an electrically conductive material and is connected to an electrical power feed line and to the other end of the resistance heating element in the same stage.

8. The furnace assembly of claim 7 wherein the resistance heating element in each stage comprises two separate resistance heating elements, each separate resistance heating element having a plurality of the rigid insulating sleeves enclosing it and substantially covering its surface and each heating element being electrically connected to the spiral shelf in the same stage and to the inner shell.

9. The furnace assembly of claim 5 wherein a separate, generally tubular, outer shell is provided about the longitudinal axis of the furnace assembly and about the inner shell in each stage.

10. The furnace assembly of claim 5 wherein the inner shell includes means for longitudinally supporting the spiral shelf underlying the heating element in each stage.

11. The furnace assembly of claim 5 wherein the stages and their heating element and spiral shelves have a generally circular configuration about the axis of the furnace assembly.

12. The furnace assembly of claim 1 having a plurality of separate heating stages formed by:

an inner shell, disposed about the longitudinal axis of the furnace assembly;

a plurality of intermeshed, bifurcated, resistance heating elements, helically wound about the longitudinal axis of the furnace assembly and about the inner shell;

a plurality of rigid insulatng sleeves enclosing each heating element and substantially covering the surface of each heating element; the plurality of insulating sleeves abutting against the leading and trailing edges of one another, against the outer, upper and lower surfaces of one another, and against the inner shell;

an outer shell, disposed about the longitudinal axis of the furnace assembly and about the inner shell and adapted to hold the insulating sleeves on the heating elements against the inner shell; and a spiral shelf provided about the longitudinal axis of the furnace assembly and about the inner shell, underlying the heating elements and abuttinhg against the outer lower surfaces of the insulating sleeves which enclose the lowermost heating element winding.

13. The furnace assembly of claim 12 wherein each heating element is provided with a straight portion at its ends extending to the bottom of the furnace assembly.

14. The furnace assembly of claim 12 wherein the heating elements are helically wound about a common, generally tubular, inner shell located about the longitudinal axis of the furnace assembly.

15. The furnace assembly of claim 14 wherein a single, generally tubular, outer shell is provided about the longitudinal axis of the furnace assembly and about the inner shell.

16. The furnace assembly of claim 15 wherein a single thickness of heating elements is wound about the inner shell.

17. The furnace assembly of claim 1 wherein the plurality of windings of the heating element are vertically aligned about the longitudinal axis of the furnace assembly.

18. The furnace assembly of claim 17 wherein the plurality of windings of the heating element and the plurality of the rigid insulating sleeves enclosing the heating element form a continuous surface about the longitudinal axis of the furnace assembly.

19. The furnace assembly of claim 1 wherein the insulating sleeves are substantially cylindrical.

20. The furnace assembly of claim 1 wherein at least about twenty insulating sleeves are provided for each winding of a resistance heating element.

21. The furnace assembly of claim 1 wherein the insulating sleeves are made of very pure alumina.

22. The furnace assembly of claim 1 which further includes: an electrical power feed line to the resistance heating element which extends from the heating element to the bottom of the furnace assembly; and a plurality of baffle plates spaced along the longitudinal axis of the furnace assembly, between the lowermost heating element winding of the furnace assembly and the bottom of the furnace assembly; the baffle plates each having at least substantially the same surface area as the furnace assembly.

23. The furnace assembly of claim 22 wherein the baffle plates each have a surface area slightly smaller than the cross-sectional area of an insulating mantle surrounding the furnace assembly.

24. The furnace assembly of claim 22 wherein at least three baffle plates are provided.

25. The furnace assembly of claim 22 wherein the inner shell contains a plurality of holes located below the lowermost heating element winding.

* * * * *